US010368157B2

(12) United States Patent
Zelnick et al.

(10) Patent No.: US 10,368,157 B2
(45) Date of Patent: Jul. 30, 2019

(54) ADJUSTABLE EARCUP IN CONTINUOUS HEADBAND-SPRING HEADPHONE SYSTEM

(71) Applicant: Bose Corporation, Framingham, MA (US)

(72) Inventors: Benjamin E. Zelnick, Somerville, MA (US); Bennett P. Daley, Waltham, MA (US); Daniel P. Baker, Warwick, RI (US)

(73) Assignee: BOSE CORPORATION, Framingham, MA (US)

( * ) Notice: Subject to any disclaimer, the term of this patent is extended or adjusted under 35 U.S.C. 154(b) by 22 days.

(21) Appl. No.: 15/726,760

(22) Filed: Oct. 6, 2017

(65) Prior Publication Data

US 2019/0110122 A1 Apr. 11, 2019

(51) Int. Cl.
*H04R 1/10* (2006.01)
*H04R 5/033* (2006.01)

(52) U.S. Cl.
CPC ..... *H04R 1/1066* (2013.01); *H04R 1/105* (2013.01); *H04R 5/0335* (2013.01)

(58) Field of Classification Search
CPC ..... H04R 1/1066; H04R 1/105; H04R 5/0335
See application file for complete search history.

(56) References Cited

U.S. PATENT DOCUMENTS 6,499,146 B2 * 12/2002 Bavetta ..... A41D 13/05 2/209
2017/0257695 A1 * 9/2017 Smiechowski ..... H04R 1/1066

FOREIGN PATENT DOCUMENTS

WO 2016005604 A1 1/2016
WO 2017155860 A1 9/2017

OTHER PUBLICATIONS

International Search Report and Written Opinion for Application No. PCT/US2018/054078, dated Jan. 21, 2019, 12 pages.

* cited by examiner

*Primary Examiner* — Sunita Joshi
(74) *Attorney, Agent, or Firm* — Hoffman Warnick LLC

(57) ABSTRACT

Various implementations include headphone systems. In one implementation, a headphone system includes: a pair of earcups; a continuous headband spring connecting the pair of earcups, the continuous headband spring having an internal slot with an opening along an inner surface thereof; and an adjustment apparatus coupled with one of the pair of earcups and the continuous headband spring, the adjustment apparatus having: a shoe coupled with the one of the pair of earcups and positioned in the internal slot; a tongue coupled with the shoe and extending at least partially along the continuous headband spring; and a resistance member coupled with the tongue for resisting movement of the tongue relative to the continuous headband spring.

11 Claims, 17 Drawing Sheets

ADJUSTABLE EARCUP IN CONTINUOUS HEADBAND-SPRING HEADPHONE SYSTEM

TECHNICAL FIELD

This disclosure generally relates to headphones. More particularly, the disclosure relates to a headphone system having an adjustable earcup.

BACKGROUND

Conventional headphones include a set of earcups joined by a headband. In some of those conventional configurations, the headband is segmented and affixed to the earcups. The segmented headband can allow for adjustment of the earcup position by moving one or more segments of the headband relative to the other segments. In other conventional configurations, the earcup is attached to a headband via an actuator such as a knob/screw or pin mechanism. In these configurations, the position of the earcup can be adjusted via the actuator (e.g., by twisting the knob/screw to loosen and then tightening after adjustment). These conventional configurations can be unwieldy. Additionally, these conventional configurations can be difficult to accurately adjust in order to provide a desirable fit for the user.

SUMMARY

All examples and features mentioned below can be combined in any technically possible way.

Various implementations include headphone systems with an integrated adjustment apparatus. In some implementations, these headphone systems have a continuous headband spring with an integrated adjustment apparatus.

In some particular aspects, a headphone system includes: a pair of earcups; a continuous headband spring connecting the pair of earcups, the continuous headband spring having an internal slot with an opening along an inner surface thereof; and an adjustment apparatus coupled with one of the pair of earcups and the continuous headband spring, the adjustment apparatus having: a shoe coupled with the one of the pair of earcups and positioned in the internal slot; a tongue coupled with the shoe and extending at least partially along the continuous headband spring; and a resistance member coupled with the tongue for resisting movement of the tongue relative to the continuous headband spring.

In other particular aspects, a headphone system includes: an earcup; a continuous headband spring connecting the earcup to an additional earcup, the continuous headband spring having an internal slot with an opening along an inner surface thereof; and an adjustment apparatus coupled with the earcup and the continuous headband spring, the adjustment apparatus having: a shoe coupled with the earcup and positioned in the internal slot; a tongue coupled with the shoe and extending at least partially along the continuous headband spring; and a friction box coupled with the tongue for resisting movement of the tongue relative to the continuous headband spring.

In additional particular aspects, a headphone system includes: a pair of earcups; a continuous headband spring connecting the pair of earcups, the continuous headband spring having a pair of internal slots each with an opening along an inner surface of the continuous headband spring; and an adjustment apparatus coupled with the pair of earcups and the continuous headband spring, the adjustment apparatus having: a pair of shoes each coupled with a corresponding one of the pair of earcups and positioned in one of the pair of internal slots; a pair of tongues each coupled with a corresponding one of the pair of shoes and extending at least partially along the continuous headband spring; and a resistance member coupled with the pair of tongues for resisting movement of each of the pair of tongues relative to the continuous headband spring.

Implementations may include one of the following features, or any combination thereof.

In some implementations, the continuous headband spring further includes an additional internal slot with an additional opening along the inner surface thereof, and the adjustment apparatus is further coupled with a second one of the pair of earcups, the adjustment apparatus further having: an additional shoe coupled with the second one of the pair of earcups and positioned in the additional internal slot; and an additional tongue coupled with the additional shoe and extending at least partially along the continuous headband spring. In certain cases, the adjustment apparatus further includes an additional resistance member coupled with the additional tongue. In some implementations, the resistance member is coupled with the additional tongue. In certain implementations, the resistance member includes a symmetrical adjustment system for symmetrically adjusting a position of each of the pair of earcups. In particular cases, the symmetrical adjustment system includes a rack and pinion system for engaging each of the tongue and the additional tongue.

In certain implementations, the resistance member includes a friction box. In some cases, the friction box includes: a housing coupled to the continuous headband spring; and at least a set of damping pads for engaging the tongue as the tongue moves relative to the continuous headband spring.

In some cases, the continuous headband spring permits movement of the pair of earcups without modifying a seam along an outer surface of the continuous headband spring.

In some implementations, the headphone system further includes a limiter for limiting movement of the shoe within the internal slot.

In certain cases, the friction box includes: a housing coupled to the continuous headband spring; and at least a set of damping pads for engaging the tongue as the tongue moves relative to the continuous headband spring. In some implementations, the set of damping pads include silicone.

In certain implementations, the friction box includes: a housing coupled to the continuous headband spring; a contact pad for engaging the tongue as the tongue moves relative to the continuous headband spring; and an actuator coupled with the housing and the contact pad for maintaining contact between the contact pad and the tongue as the tongue moves relative to the continuous headband spring.

In particular implementations, the continuous headband spring permits movement of the earcup without modifying a seam along an outer surface of the continuous headband spring. In some cases, the resistance member includes a symmetrical adjustment system for symmetrically adjusting a position of each of the pair of earcups. In certain implementations, the symmetrical adjustment system includes a rack and pinion system for engaging each of the pair of tongues. In some implementations, the resistance member includes a friction box permitting independent adjustment of a position of each of the pair of earcups. In particular cases, the continuous headband spring permits movement of the pair of earcups without modifying a seam along an outer surface of the continuous headband spring.

Two or more features described in this disclosure, including those described in this summary section, may be combined to form implementations not specifically described herein.

The details of one or more implementations are set forth in the accompanying drawings and the description below. Other features, objects and benefits will be apparent from the description and drawings, and from the claims.

Figure 1:
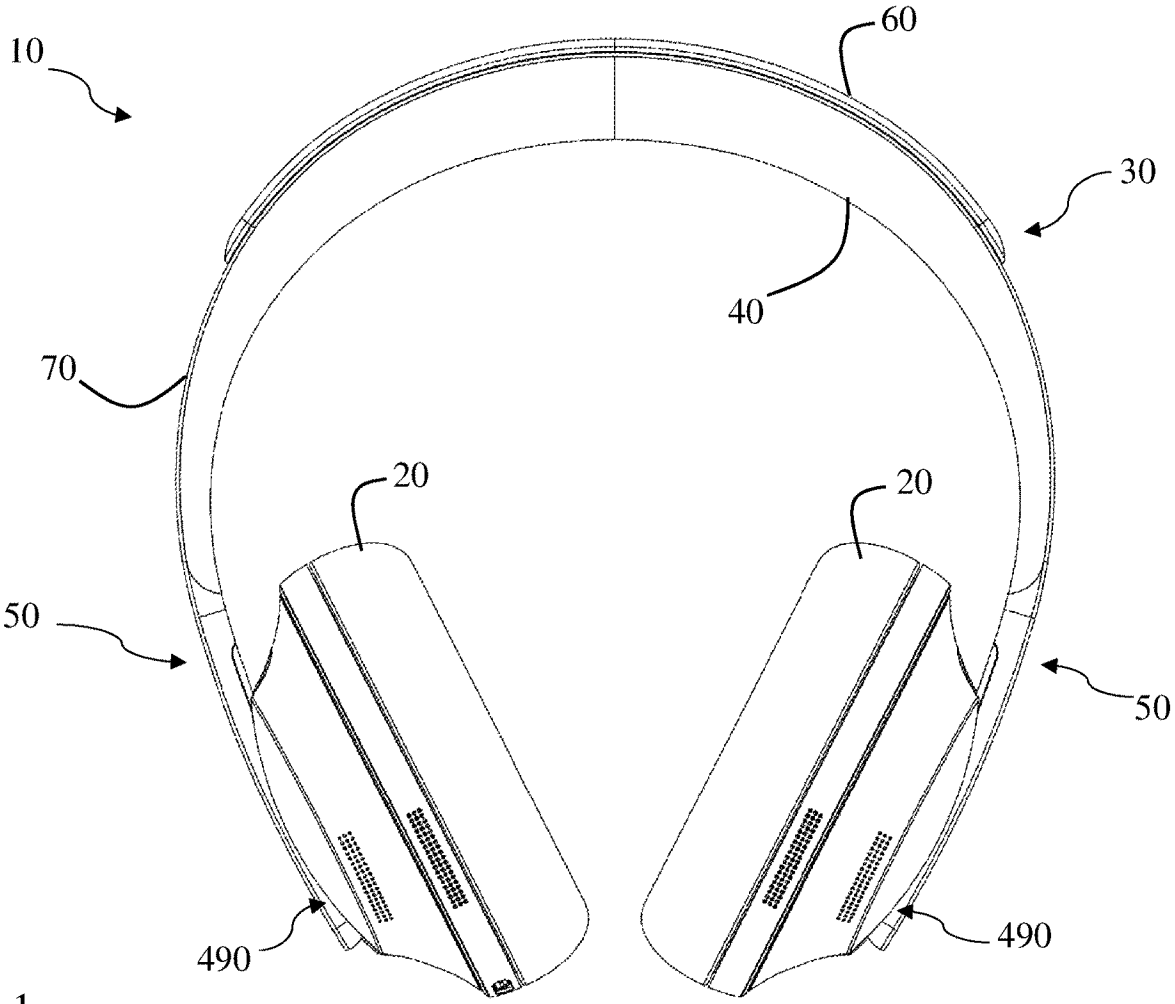
FIG. 1 shows a perspective view of a headphone system according to various implementations.

It is noted that the drawings of the various implementations are not necessarily to scale. The drawings are intended to depict only typical aspects of the disclosure, and therefore should not be considered as limiting the scope of the implementations. In the drawings, like numbering represents like elements between the drawings.

DETAILED DESCRIPTION

This disclosure is based, at least in part, on the realization that a continuous headband spring with an adjustment apparatus can be beneficially incorporated into a headphone system. For example, a headphone system can include a continuous headband spring with an adjustment apparatus that provides an effective, smooth mode of adjustment for a set of earcups.

Commonly labeled components in the FIGURES are considered to be substantially equivalent components for the purposes of illustration, and redundant discussion of those components is omitted for clarity.

A headphone refers to a device that fits around, on, or in an ear and that radiates acoustic energy into the ear canal. Headphones are sometimes referred to as earphones, earpieces, headsets, earbuds or sport headphones, and can be wired or wireless. A headphone includes an acoustic driver to transduce audio signals to acoustic energy. The acoustic driver may be housed in an earcup. While some of the figures and descriptions following show a single headphone, a headphone may be a single stand-alone unit or one of a pair of headphones (each including a respective acoustic driver and earcup), one for each ear. A headphone may be connected mechanically to another headphone, for example by a headband and/or by leads that conduct audio signals to an acoustic driver in the headphone. A headphone may include components for wirelessly receiving audio signals. A headphone may include components of an active noise reduction (ANR) system. Headphones may also include other functionality such as a microphone so that they can function as a headset.

In an around or on-the-ear headphone, the headphone may include a headband and at least one earcup that is arranged to sit on or over an ear of the user. In order to accommodate heads of different sizes and shapes, the earcups are configured to pivot about the vertical and/or horizontal axes, and to translate for some distance along the vertical axis.

Headphones according to various implementations herein can include a continuous headband spring coupled with one or more earcups. The headband spring can provide the desired clamping pressure in the headphones in order to maintain contact between the earcup(s) and the user's head. In the dual-earcup configuration, the headband spring can provide a significant portion (e.g., nearly all) of the clamping pressure between the earcups. This continuous headband spring can be formed of a single piece of material (e.g., a metal or composite material) or can be formed of a plurality of separate pieces coupled together. The continuous headband spring can be coupled with a head cushion for interfacing with a user's head. In particular cases, the continuous headband spring connects a pair of earcups. This continuous headband spring configuration can allow for adjustment of the position of the earcups without modifying a position of the headband spring or the cushion. That is, the continuous headband spring configuration allows the user to adjust the position of the earcups relative to the headband spring, without altering the length of the headband spring (or the cushion). In particular implementations, the continuous headband spring can include an internal slot for accommodating an adjustment apparatus that adjusts each of the earcups.

FIG. 1 shows a perspective view of a headphone system 10 according to various implementations. As shown, headphone system 10 can include a pair of earcups 20 configured to fit over the ear, or on the ear, of a user. A headband 30 spans between the pair of earcups 20 (individually labeled as earcups 20) and is configured to rest on the head of the user (e.g., spanning over the crown of the head or around the head). The headband 30 can include a head cushion 40, which is coupled with a continuous headband spring 50 (partially obstructed by head cushion 40 in this view). A headband cover 60 is also shown covering a portion of the outer surface 70 of the headband spring 50.

According to various implementations, continuous headband spring 50 connects the pair of earcups 20, and permits movement of the earcup(s) 20 without modifying a length of the continuous headband spring (also referred to as "headband spring") 50. That is, according to various implementations, earcups 20 are configured to move independently of the outer surface 70 of the headband spring 50, such that earcups 20 appear to slide, rotate or otherwise translate along the headband spring 50.

Figure 2:
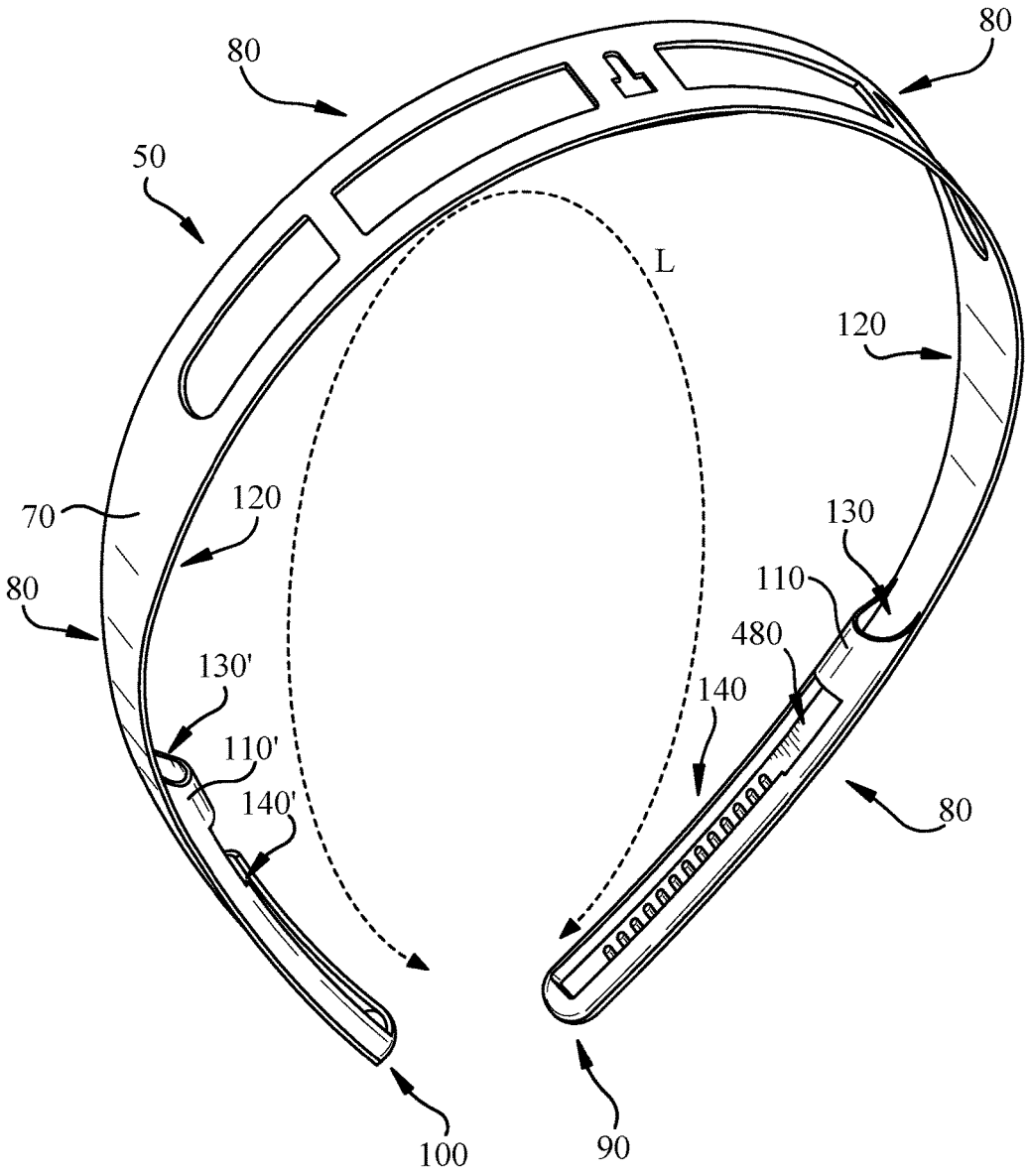
FIG. 2 shows a schematic view of a headband spring according to various implementations.

FIG. 2 shows a schematic depiction of the headband spring 50 according to various implementations. The headband spring 50 can be formed of one or more segments 80 of material, e.g., a metal such as aluminum or steel, a thermoplastic material (e.g., polycarbonate (PC) or acrylonitrile butadiene styrene (ABS)) or a composite material (e.g., PC/ABS). Segments 80 can be formed in an integral process (e.g., via casting, forging and/or three-dimensional manufacturing), or can be formed separately and subsequently joined together (e.g., via welding, brazing and/or mechanical linking). In some cases, segments 80 proximate a first end 90 and a second end 100 of the headband spring 50 can include a sleeve 110. The sleeve 110 can be integrally formed (as described herein) with these corresponding segments 80, or may be formed separately and later joined (as described herein). Sleeve 110 can be formed of a similar material as segments 80 of headband spring 50, or may be formed of a distinct material (e.g., a plastic such as any plastic described herein). The headband spring 50 can have a length (L) as measured from the first end 90 to the second end 100. In some implementations, during adjustment of the earcups 20 (FIG. 1), the length (L) of headband spring 50 remains constant. That is, headband spring 50 is configured to remain at a constant length (L) during use of the headphone system 10 and provide the clamping pressure between earcups 20 (FIG. 1) and the user's head.

With continuing reference to FIG. 2, as used herein, the outer surface 70 of headband spring 50 can refer to the surface of the headband spring aligned to face away from the head of the user. Opposing the outer surface 70 is an inner surface 120, which is aligned to face the head of the user. As shown in FIG. 2, the sleeve 110 is located along the inner surface 120, and can define an internal slot 130 with an opening 140 along that inner surface 120. In some cases, as further described herein, the internal slot 130 can be sized to allow headband spring 50 to connect with each earcup 20. It is understood that in various configurations, e.g., where headphone system 10 includes a pair of earcups 20, the headband spring 50 can include an additional sleeve 110' defining an additional internal slot 130' with an additional opening 140' along the inner surface 120.

Figure 3:
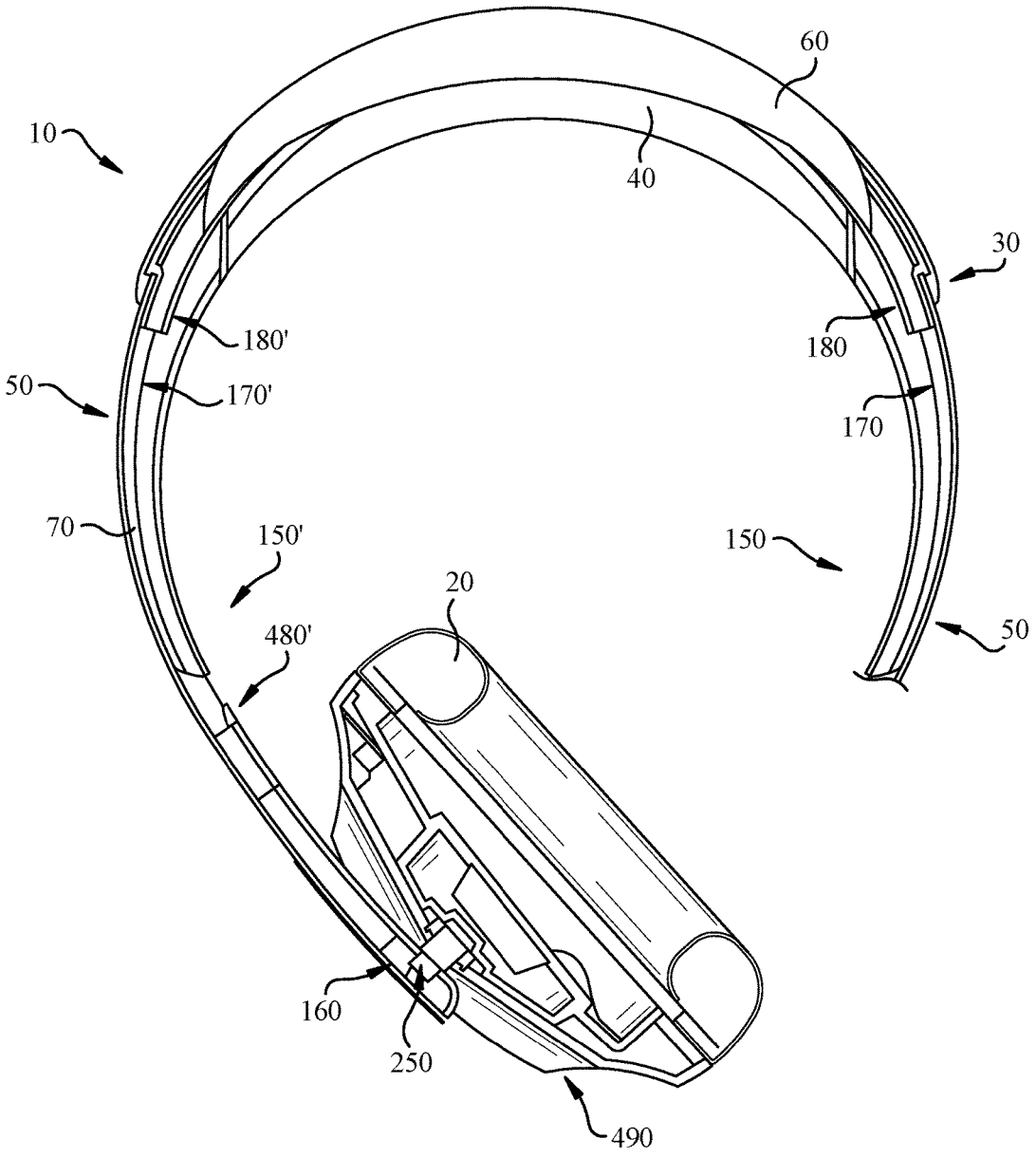
FIG. 3 shows a partially transparent perspective view of a portion of a headphone system according to various implementations.
Figure 4:
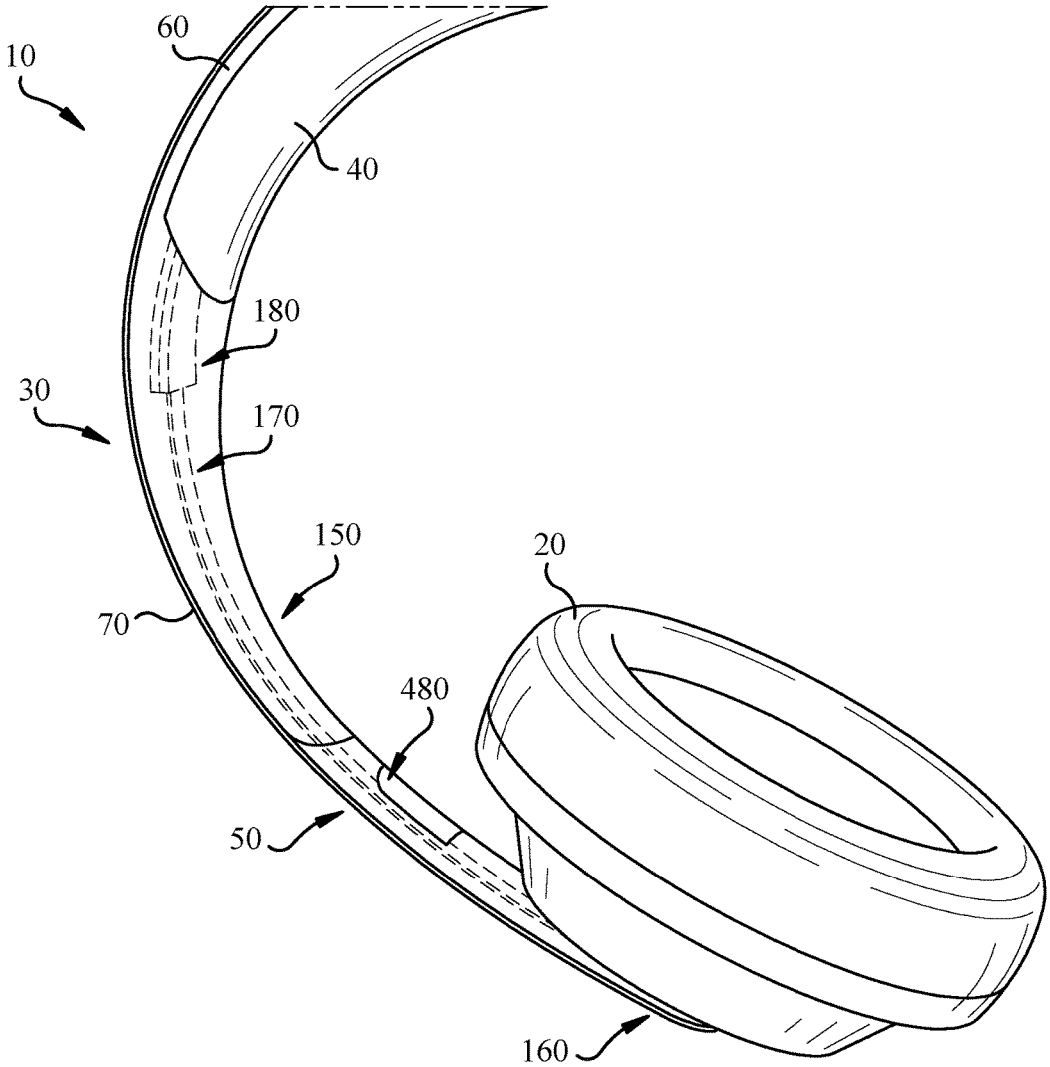
FIG. 4 shows a partially transparent perspective view of a portion of a headphone system according to various additional implementations.
Figure 5:
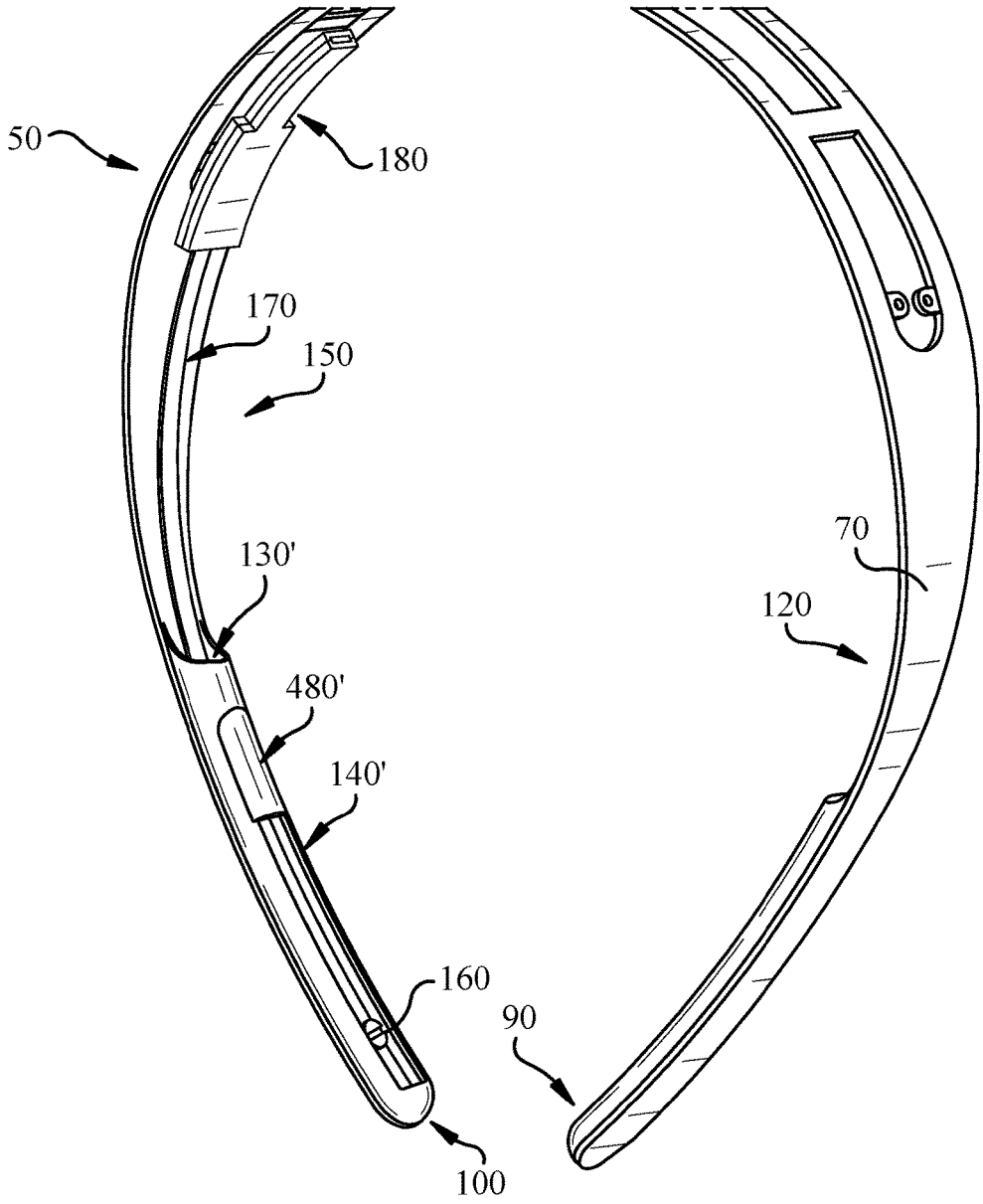
FIG. 5 shows a schematic view of a headband spring and an adjustment apparatus according to various implementations.

FIG. 3 illustrates a partial skeletal view of the headphone system 10, illustrating aspects of the headband spring 50, the head cushion 40 and the headband cover 60. Partially shown in this view are aspects of an adjustment apparatus 150, further shown and described with respect to additional figures herein. FIG. 4 shows a close-up skeletal view with a partially transparent head cushion 40 in order to demonstrate aspects of the headband spring 50 and the adjustment apparatus 150. FIG. 5 shows a perspective view of an example adjustment apparatus connected with the headband spring 50. These FIGURES are referred to simultaneously. As shown, the headphone system 10 can further include an adjustment apparatus 150 coupled with one of the pair of earcups 20 and the headband spring 50. As shown most clearly in FIG. 5, the adjustment apparatus 150 can include: a shoe 160 coupled with the earcup 20 and positioned in the internal slot 130, a tongue 170 coupled with the shoe 160 and extending at least partially along (e.g., along the length of) the headband spring 50, and a resistance member 180 coupled with the tongue 170 for resisting movement of the tongue 170 relative to the headband spring 50. As described herein and shown with reference to FIGS. 1-3, according to some implementations, the headphone system 10 can include an additional adjustment apparatus 150', including an additional shoe 160', additional tongue 170' and additional resistance member 180'. These adjustment apparatuses 150, 150' can permit adjustment of both earcups 20 either independently, or in a coordinated manner.

Figure 6:
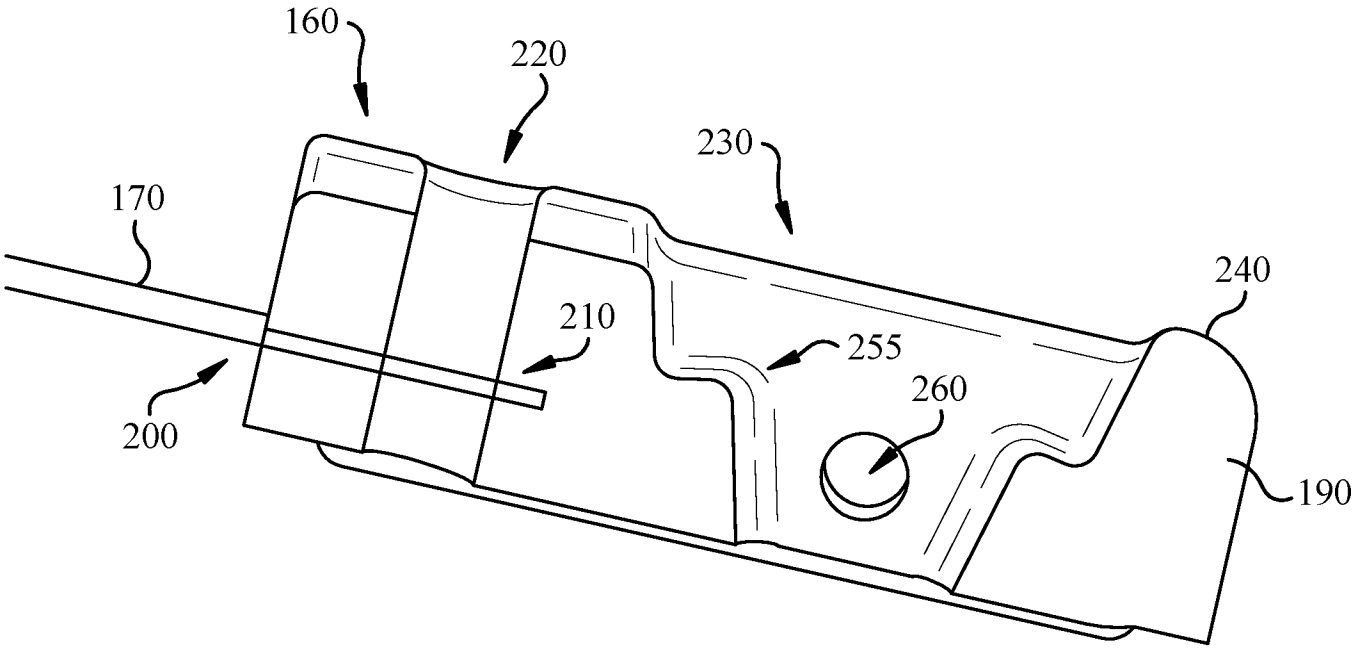
FIG. 6 shows a close-up side view of a portion of the adjustment apparatus of FIG. 5.

FIG. 6 shows a close-up perspective view of an example shoe 160 according to various implementations. Shoe 160 is shown coupled with tongue 170 (partially illustrated in this view) and isolated from earcup 20. In some cases, shoe 160 can include a body 190 having a slot 200 or other mating feature for connecting with a terminal portion 210 of the tongue 170. In some examples, body 190 can be formed of a metal such as aluminum or steel, a thermoplastic material (e.g., polyoxymethylene (POM), PC or ABS) or a composite material (e.g., PC/ABS). In various implementations, the slot 200 can include a groove or other opening sized to receive the terminal portion 210 of the tongue 170. According to some implementations, the shoe 160 can include a coupler opening 220 to receive a coupler for joining the shoe 160 with the tongue 170. In some cases, the coupler can include a pin, screw, bolt, ring, etc. configured to couple the shoe 160 with the tongue 170. In various implementations, shoe 160 can further include a recess 230 along its inner face 240 for receiving a protrusion (e.g., knob or flange) 250 (FIG. 3) extending from the earcup 20. In some cases, the recess 230 includes a ridge 255 for engaging the protrusion 250 from the earcup 20 (FIG. 3), and in some example implementations, the recess 230 can include a coupler slot 260 for receiving a coupler (e.g., pin, screw, bolt or ring) to join the shoe 160 with the earcup 20. However, in other implementations, recess 230 can be sized to couple with the protrusion 250 via a pressure fit, e.g., via a force fit or flex fit. In some implementations, shoe 160 is fixedly coupled with tongue 170 such that shoe 160 is designed to move with tongue 170 during adjustment of the earcup 20.

Figure 7:
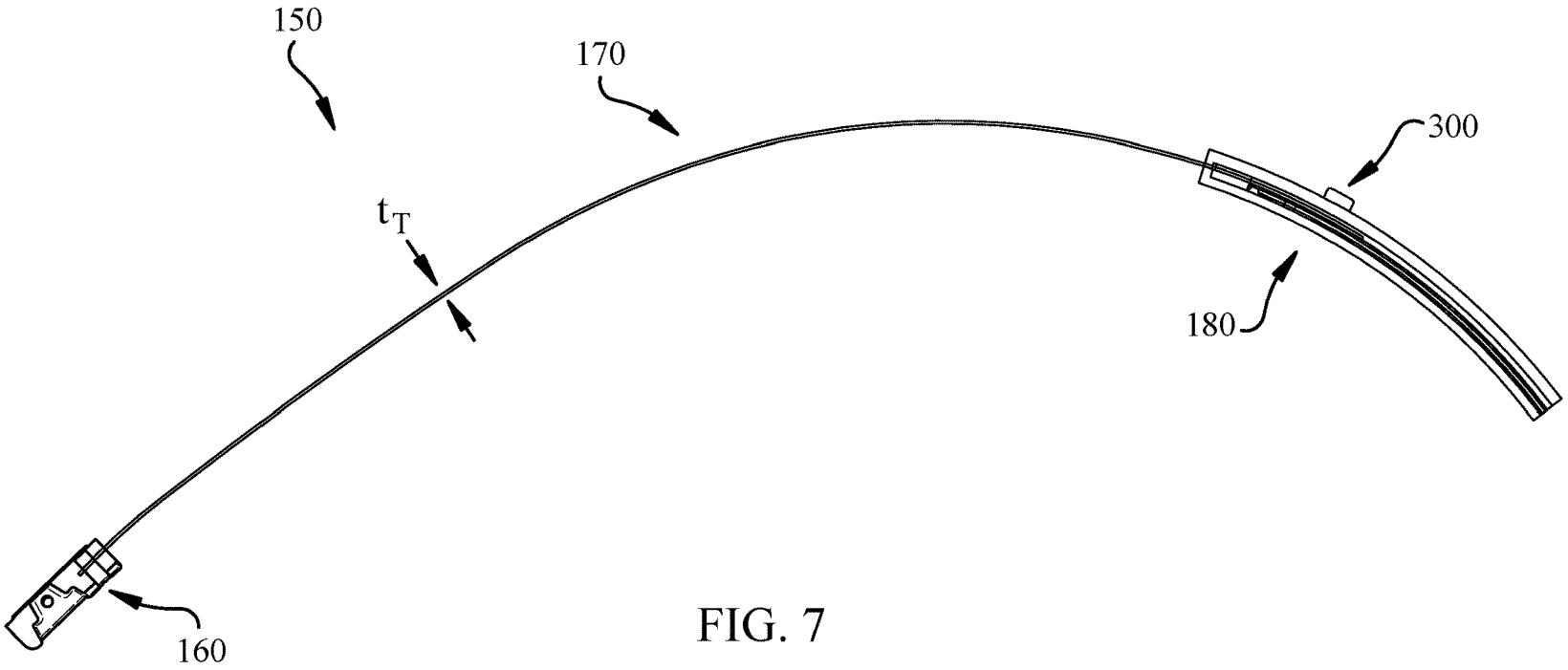
FIG. 7 shows a perspective view of another portion of the adjustment apparatus of FIG. 5.

FIG. 7 shows features of the tongue 170 coupled with shoe 160 and resistance member 180. In various implementations, tongue 170 is formed of a metal such as steel or aluminum or a thermoplastic such as polypropylene. According to various example implementations, tongue 170 can have a thickness ($t_T$) ranging between approximately 0.01 millimeters (mm) and approximately 5 (mm). In some cases, depending upon the material type of the tongue 170, its thickness may vary. For example, where tongue 170 is formed of steel such as a spring steel, it may have a thickness ranging between approximately 0.01 mm to approximately 2 mm. In other examples, where tongue 170 is formed of a polypropylene, it may have a thickness ranging between approximately 0.01 mm to approximately 4-5 mm. In still other examples, where tongue 170 is formed of aluminum, it may have a thickness ranging between approximately 0.01 mm to approximately 2 mm. It is understood that these example materials and thicknesses are merely illustrative of various possible implementations, and are not limiting of any implementation disclosed herein. Tongue 170 can have a width (measured perpendicular to thickness ($t_T$)) less than a width of the headband spring 50, and can have length equal to approximately one-quarter to one-half of the length (L) of the headband spring 50 (e.g., depending upon the location of resistance member 180 along headband spring 50). As shown in FIG. 5 and FIG. 7, the tongue 170 is either pre-loaded (arced) or can be configured to arc along the curvature of the headband spring 50. In example implementations, the tongue 170 has a modulus of elasticity of approximately 65,000 Mega pascal (MPa) to approximately 75 Giga pascal (GPa). In some example implementations, where tongue 170 is formed of spring steel (such as spring steel 1095), it may have a modulus of elasticity of approximately 65,000 MPa to approximately 90,000 MPa. In other example implementations, where tongue 170 is formed of polypropylene, it may have a modulus of elasticity of approximately 1.5 GPa to approximately 2 GPa. In other example implementations, where tongue 170 is formed of aluminum, it may have a modulus of elasticity of approximately 65 GPa to approximately 75 GPa. It is understood that these example moduli are merely illustrative of various possible implementations, and are not limiting of any implementation disclosed herein. As described herein, tongue 170 is configured to move relative to the resistance member 180 in order to allow for adjustment of the position of earcup 20 relative to headband spring 50 (without changing the length (L) of that headband spring 50).

FIG. 7 also illustrates an example depiction of a resistance member 180 for resisting movement of the tongue 170 relative to the headband spring 50 (also shown in FIG. 5). That is, according to particular implementations, resistance member 180 can be fixedly coupled with the headband spring 50, such that resistance member 180 remains stationary with respect to the headband spring 50 during adjustment of earcup(s) 20. FIG. 7 shows one example implementation whereby resistance member 180 is coupled with a single tongue 170 for resisting movement of that tongue 170 relative to headband spring 50 (FIG. 5). This configuration can allow for independent adjustment of the position of earcups 20 relative to the headband spring 50 (FIG. 1). However, as described herein, other example implementations include a resistance member 180 that is configured to resist movement of distinct tongues 170 (e.g., a first tongue 170 and an additional tongue 170') in order to control movement of a pair of earcups 20. In these example implementations, the single resistance member 180 can be configured to resist movement of distinct tongues 170, 170' to control independent, or symmetrical (e.g., simultaneous), movement of earcup(s) 20. In various implementations, the adjustment apparatus 150, and in particular, the resistance member(s) 180 described herein can be configured to retain the position of each earcup 20 at each adjustment, such that the earcup 20 does not unintentionally slide or default to a particular position. In this sense, the resistance member(s) 180 can include a sufficient coefficient of friction (or a retention mechanism) to resist undesired relocation of the earcup(s) 20 during use.

Figure 8:
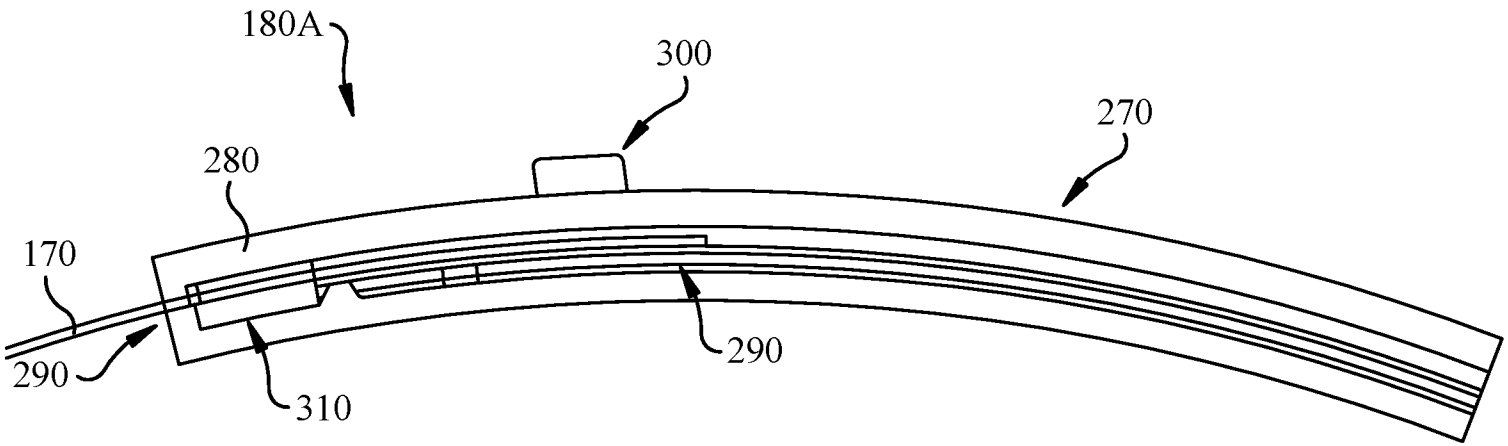
FIG. 8 shows a perspective view of an additional portion of the adjustment apparatus of FIG. 5.
Figure 9:
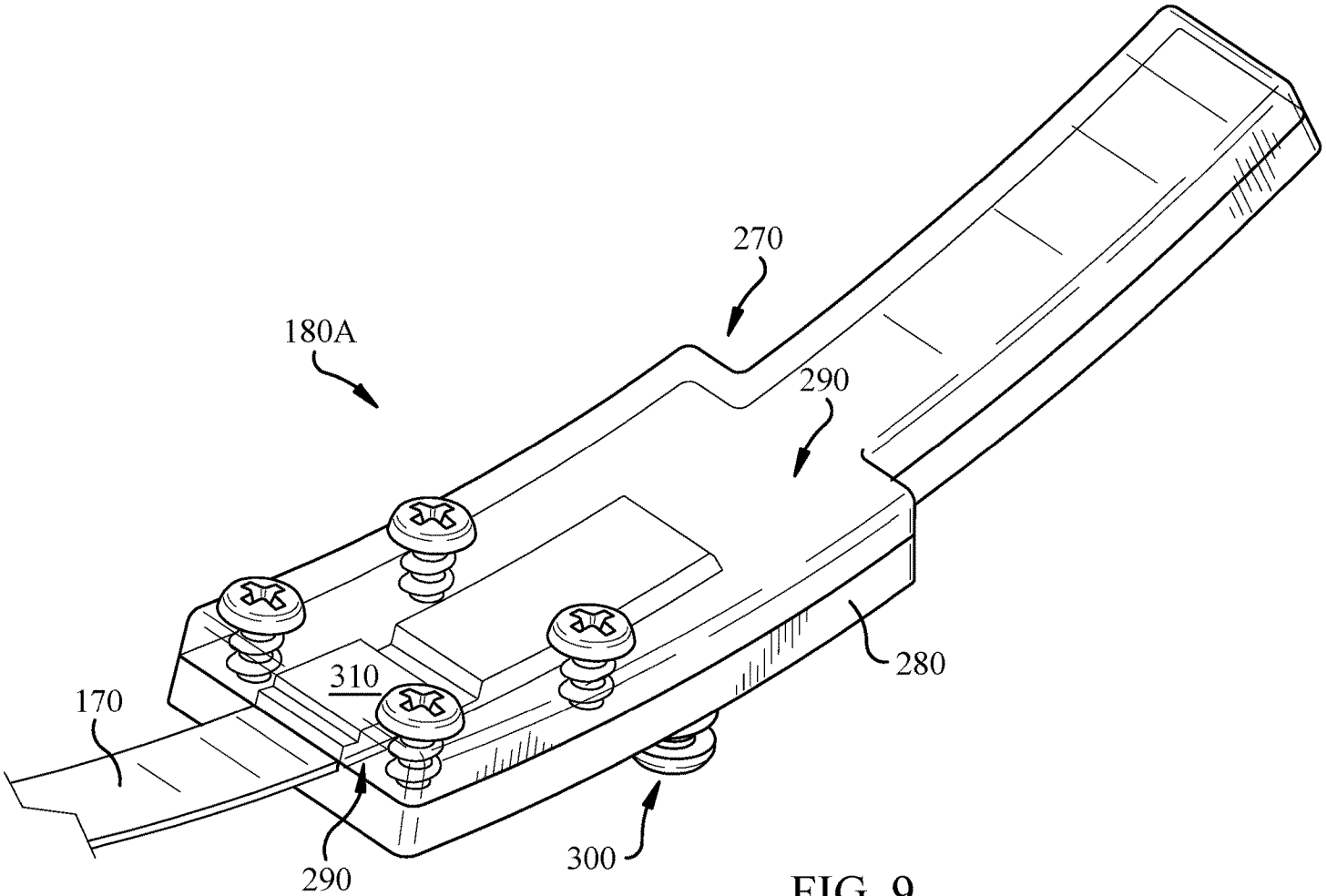
FIG. 9 shows a perspective view of an example portion of an adjustment apparatus according to various implementations.

FIG. 8 is a close-up depiction of one implementation of a resistance member 180A according to some implementations. FIG. 9 shows a perspective view of the resistance member 180A of FIG. 8. With reference to both FIG. 8 and FIG. 9, in some implementations, the resistance member 180A can include a friction box. In these cases, the resistance member 180A can include a housing 270 coupled to the headband spring 50 (e.g., as shown in FIG. 5). The housing 270 can include one or more pieces of metal such as steel or aluminum, a thermoplastic material (e.g., POM, PC or ABS) or a composite material such as PC/ABS. According to various implementations, housing 270 can include a main body 280 with a slot 290 for receiving the tongue 170. In some cases, housing 270 is coupled with headband spring 50 by one or more couplers 300 (e.g., a bolt, screw, pin, or mating member). Couplers 300 can be configured to engage a mating slot or other opening in the headband spring 50. However, it is understood that housing 270 could also include one or more openings for engaging a (male) coupler extending from headband spring 50. In any case, housing 270 is configured to couple with headband spring 50 to aid in resisting movement of the tongue 170 as one or more earcup(s) 20 is adjusted.

In some cases, as shown in the example friction box configuration in FIG. 8 and FIG. 9, the resistance member 180A can include at least a set of damping pads 310 for engaging the tongue 170 as the tongue 170 moves relative to the headband spring 50 (FIG. 5). One damping pad 310 is shown in the depiction of FIG. 9, however, it is understood that a plurality of damping pads 310 can be used to engage the tongue 170 as it moves through the housing 270. In some cases, a damping pad 310 is affixed to an internal wall of the housing 270 and aligned to contact the tongue 170 as it moves through the slot 290. In some other cases, two or more damping pads 310 can be positioned along the internal wall of the housing 270 to contact the tongue 170 as it moves through the slot 290. Various implementations include damping pads 310 made of silicone, a thermoplastic (e.g., POM) or a thermoplastic elastomer (TPE) for contacting the tongue 170 and providing a frictional force on that tongue 170 as it slides through slot 290.

Figure 10:
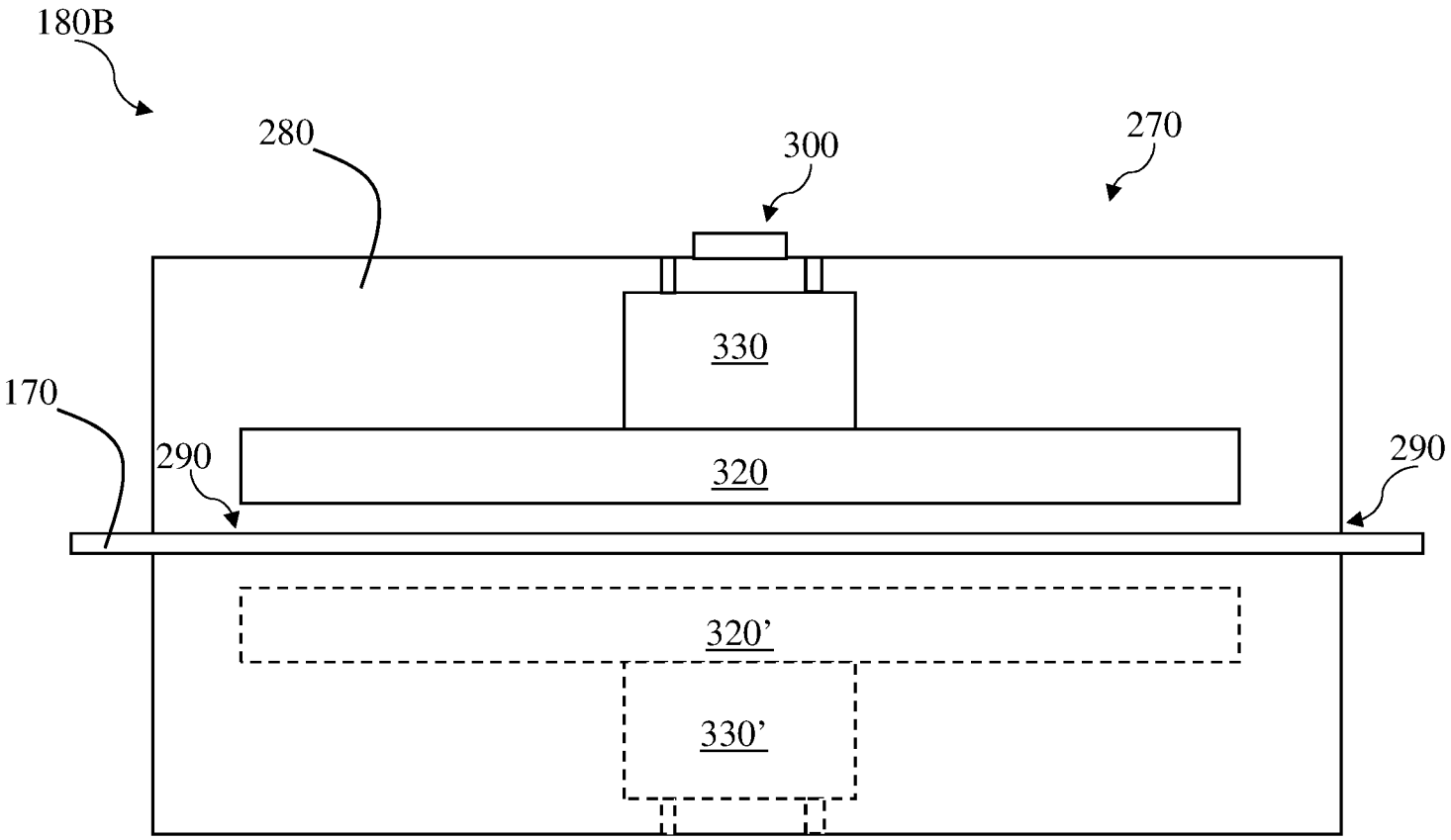
FIG. 10 shows a cross-sectional view of an example portion of an adjustment apparatus according to various additional implementations.

FIG. 10 shows a schematic cross-sectional view of a portion of another resistance member 180B according to additional implementations. In this depiction, the housing 270 is shown including a contact pad 320 for engaging the tongue 170 as the tongue 170 moves relative to the headband spring 50 (FIG. 5). In these implementations, an actuator 330 is coupled with the housing 270 (e.g., via conventional coupler(s) such as a screw, pin, bolt, adhesive, etc.) and the contact pad 320 to maintain contact between the contact pad 320 and the tongue 170 as the tongue 170 moves relative to the headband spring 50 (FIG. 5). In some cases, the contact pad 320 can include a material similar to the damping pad(s) 310 (e.g., silicone, a thermoplastic (e.g., POM) or a thermoplastic elastomer (TPE)) for contacting tongue 170 and providing a frictional force against the tongue 170 as it moves through the slot 290. The actuator 330 can provide a contact force on the contact pad 320 to contact tongue 170 in slot 290. In some cases, the actuator 330 can include a spring or a compliant mechanism for providing a force on the contact pad in a direction normal to the movement of the tongue 170. Various implementations can include a plurality of contact pads 320 (and corresponding actuator(s) 330) for resisting movement of the tongue 170 as it moves through slot 290. An additional contact pad 320' and additional actuator 330' are shown in phantom in FIG. 10 as an example of this implementation.

Figure 11:
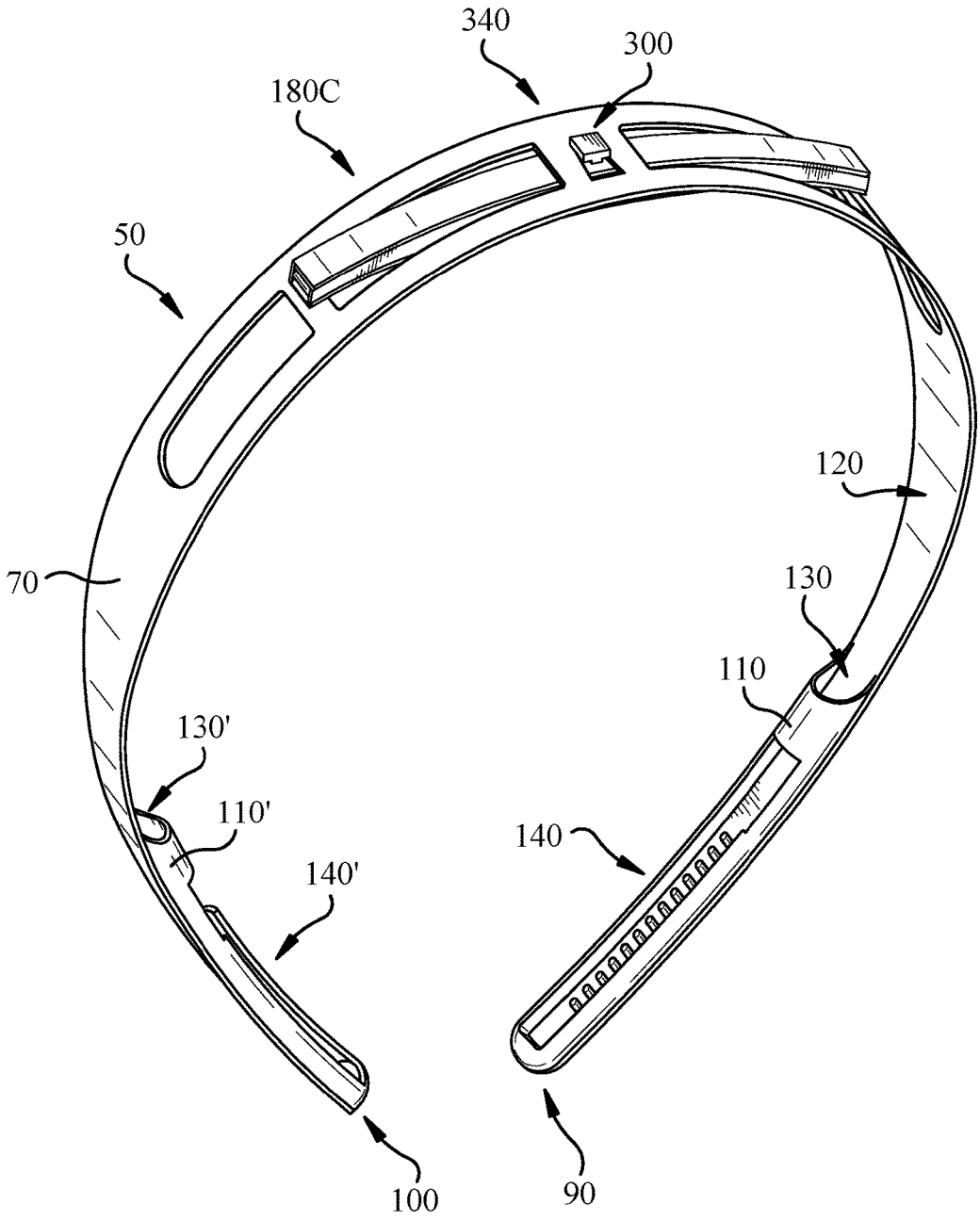
FIG. 11 shows a schematic view of a headband spring and a resistance member according to various implementations.
Figure 12:
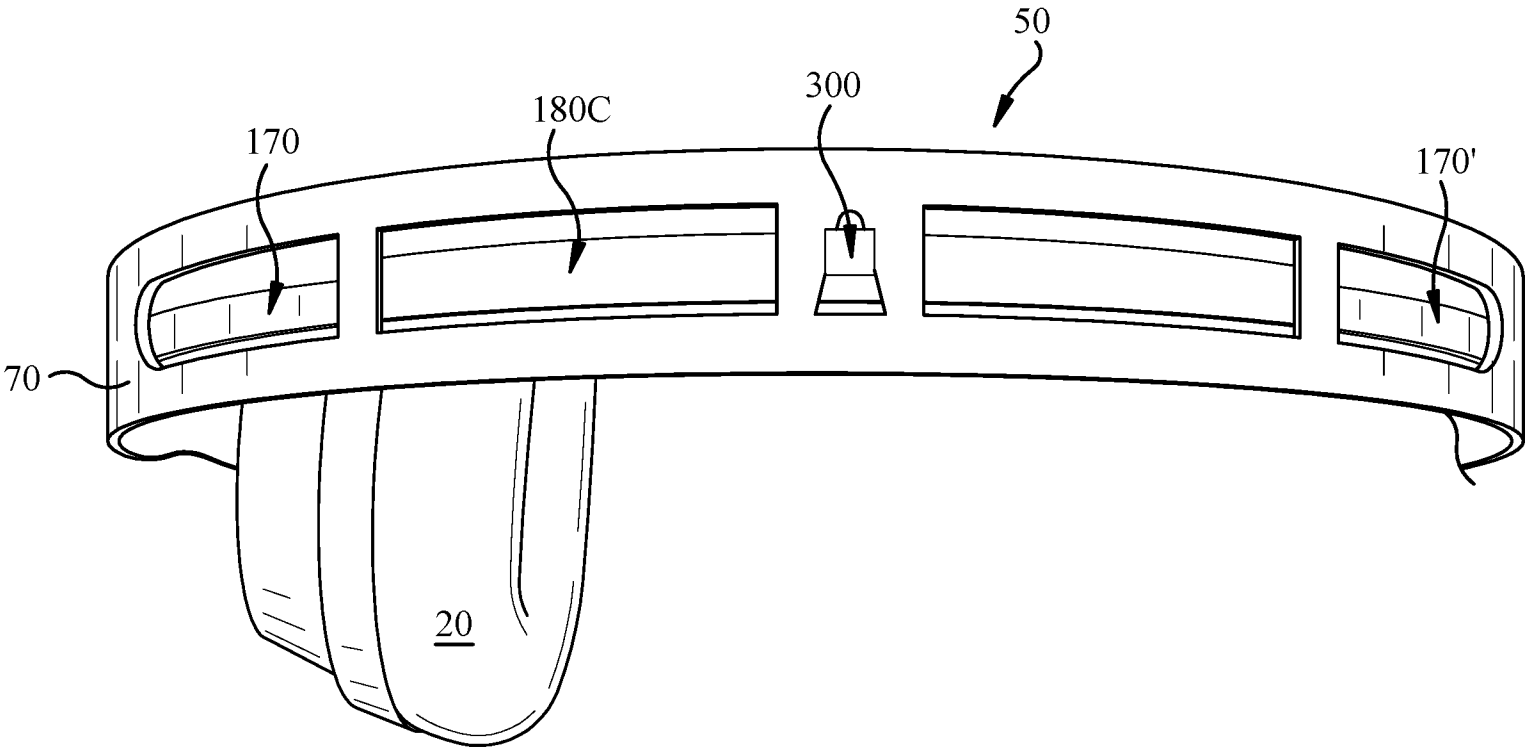
FIG. 12 shows a top perspective view of the headband spring and resistance member of FIG. 11, further illustrating an earcup and a tongue, according to various implementations.
Figure 13:
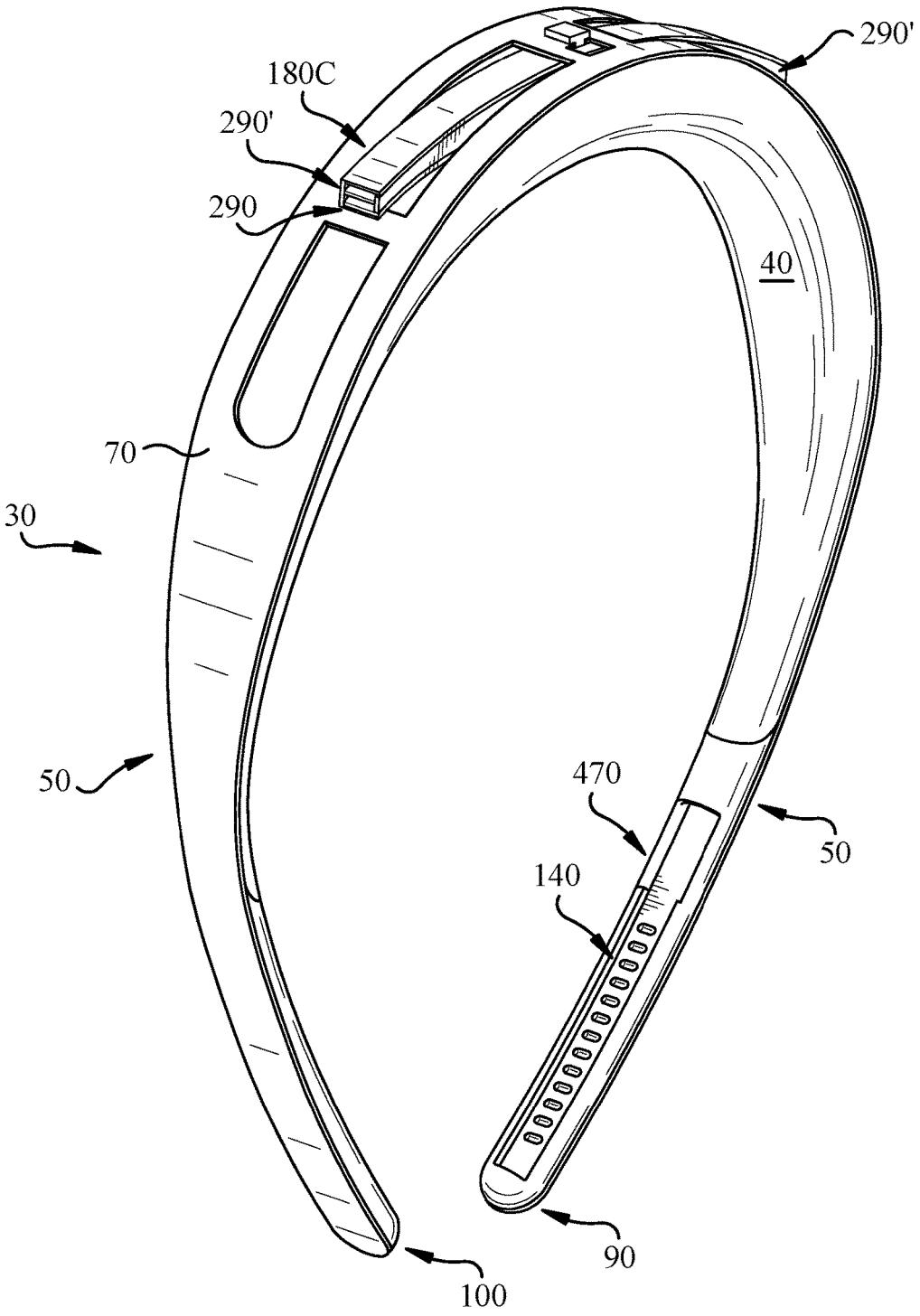
FIG. 13 shows a schematic view of a headband spring with a resistance member and a head cushion, according to various implementations.

In some particular implementations, the resistance member 180 can be configured to resist movement of a plurality of tongues 170, 170' (e.g., two tongues) in a centralized resistance configuration. That is, some implementations include a headphone system 10 with a single resistance member 180C for resisting movement of tongue 170 and the additional tongue 170' (FIG. 3). In these implementations, as shown in the schematic depiction of FIG. 11, a single resistance member 180C can be coupled with headband spring 50 proximate a crown section 340 of that headband spring 50 to centrally (with respect to the length (L) of headband spring) control movement of a pair of tongues 170 (FIG. 12). In the example depiction in FIG. 11, the resistance member 180C can optionally include the additional function of a spacer to provide a counter-force against headband spring 50 and maintain a spacing between earcups 20 (FIG. 12) in a resting state (e.g., when not engaged with the head of the user). In this example depiction, the resistance member 180C is shown extending outside of the arc of headband spring 50. However, it is understood that resistance member 180C can be tucked within the arc of the headband spring to engage tongues 170, 170' in order to control movement of a pair of earcups 20. This tucked arrangement is illustrated in the top view of FIG. 12. As noted above, in this implementation, the resistance member 180C can optionally function as a spacer, however, such a function is not necessary. FIG. 13 shows another perspective view of the configuration of FIG. 11, further including the head cushion 40. As shown in FIG. 13, in some cases, the resistance member 180C can include two slots 290, 290' for receiving respective tongues 170, 170' from each of the adjustment apparatuses 150, 150'. In some cases, slots 290, 290' extend through the resistance member 180C such that openings for each slot are located on distinct sides of the main body. In particular implementations, the resistance member 180C can include one or more damping pads 310 (FIG. 9) and/or contact pads 320 (FIG. 10) positioned to contact tongue 170 and tongue 170' and resist movement of those tongues 170, 170' as earcups 20 are repositioned.

Figure 14:
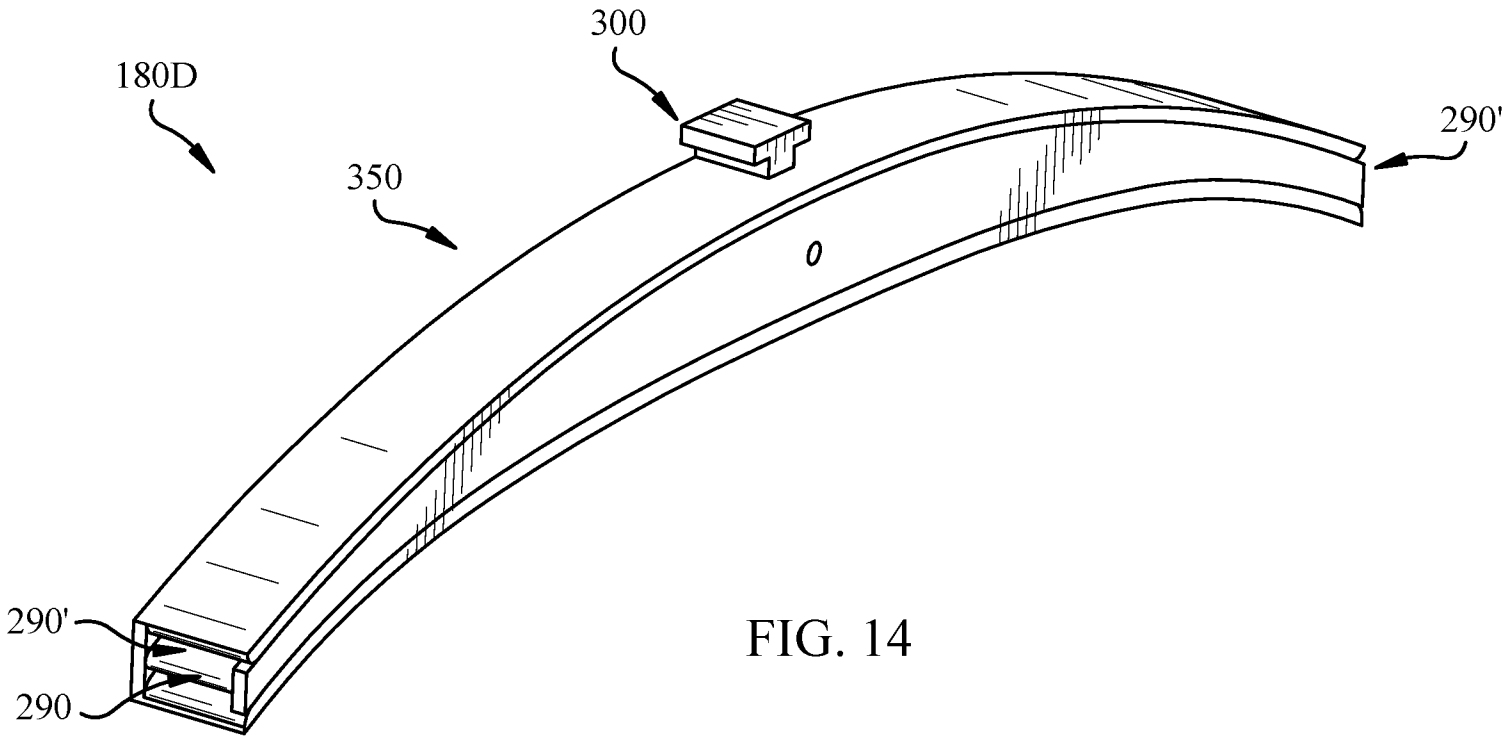
FIG. 14 shows a close-up perspective view of an embodiment of a resistance member according to various particular implementations.
Figure 15:
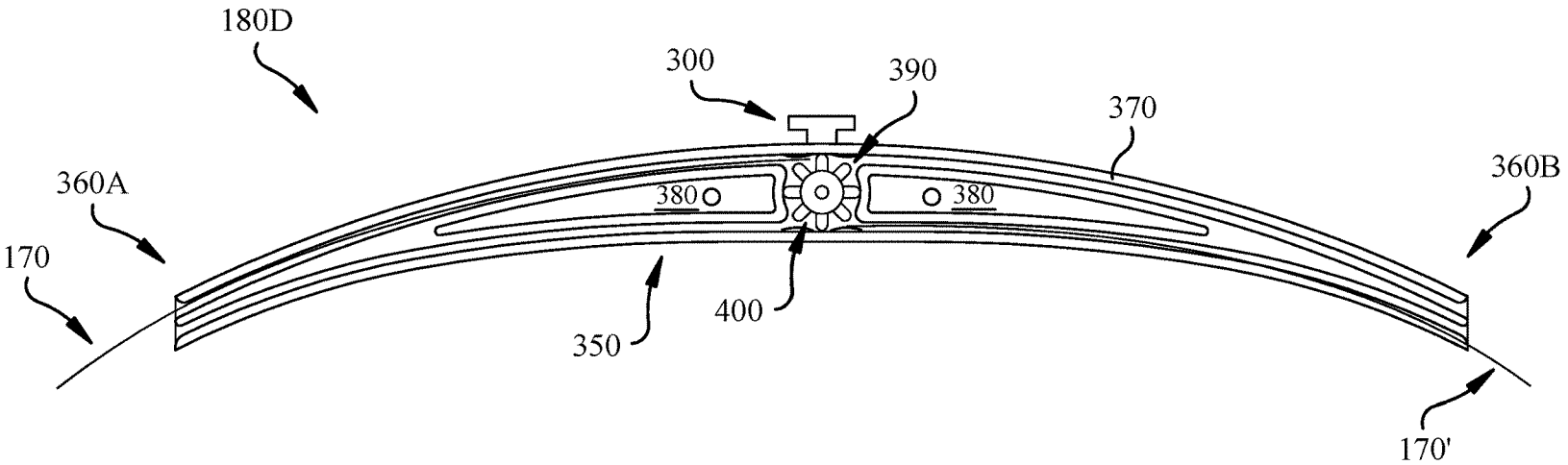
FIG. 15 shows a cross-sectional view of the resistance member of FIG. 14.

FIG. 14 shows a perspective view of an additional implementation of a resistance member 180D in isolation. FIG. 15 shows resistance member 180D in a partial cross-sectional view. Referring to both FIG. 14 and FIG. 15, in these implementations, resistance member 180D can include a symmetrical adjustment system for symmetrically adjusting a position of each of the earcups 20 (via tongues 170, 170'). In some cases, the symmetrical adjustment system can include a rack and pinion system for controlling movement of tongue 170 and additional tongue 170'. With particular attention to FIG. 15, aspects of the resistance member 180D can include a spreader 350 for separating tongues 170 and 170' entering from opposite sides 360A, 360B of the resistance member 180D. That is, the spreader 350 can include a housing 370 and a pair of wedge-shaped members 380 for directing tongue 170 and tongue 170' toward a central control member 390. In some cases, the central control member 390 includes a pinion gear 400 coupled with the housing 370 and configured to engage apertures in the tongue 170 and tongue 170' (e.g., notches or through-holes) as it rotates. In various implementations, the wedge-shaped members 380 direct tongue 170 over a top portion of the pinion gear 400 and direct tongue 170' under a bottom portion of the pinion gear 400. In this sense, the resistance member 180D is configured to receive tongue 170 and tongue 170' and symmetrically adjust the position of those tongues (e.g., via corresponding apertures) such that movement of one tongue 170 initiates movement of the other tongue 170' (and vice versa). As such, a user can adjust the position of one earcup 20 (FIG. 1), and the other earcup 20 in the pair will simultaneously adjust relative to the headband spring 50. That is, the pinion gear 400 is configured to rotate when engaged with a moving tongue 170, 170', and simultaneously adjust the other tongue 170, 170' connected at the opposite portion of the gear 400. As with the other resistance members 180A, 180B, 180C, resistance member 180D can be formed of any material capable of performing the resistance functions described herein. That is, resistance members 180 shown and described herein can be formed of one or more metals, plastics and/or composite materials described with respect to any component of the headphone system 10.

Figure 16:
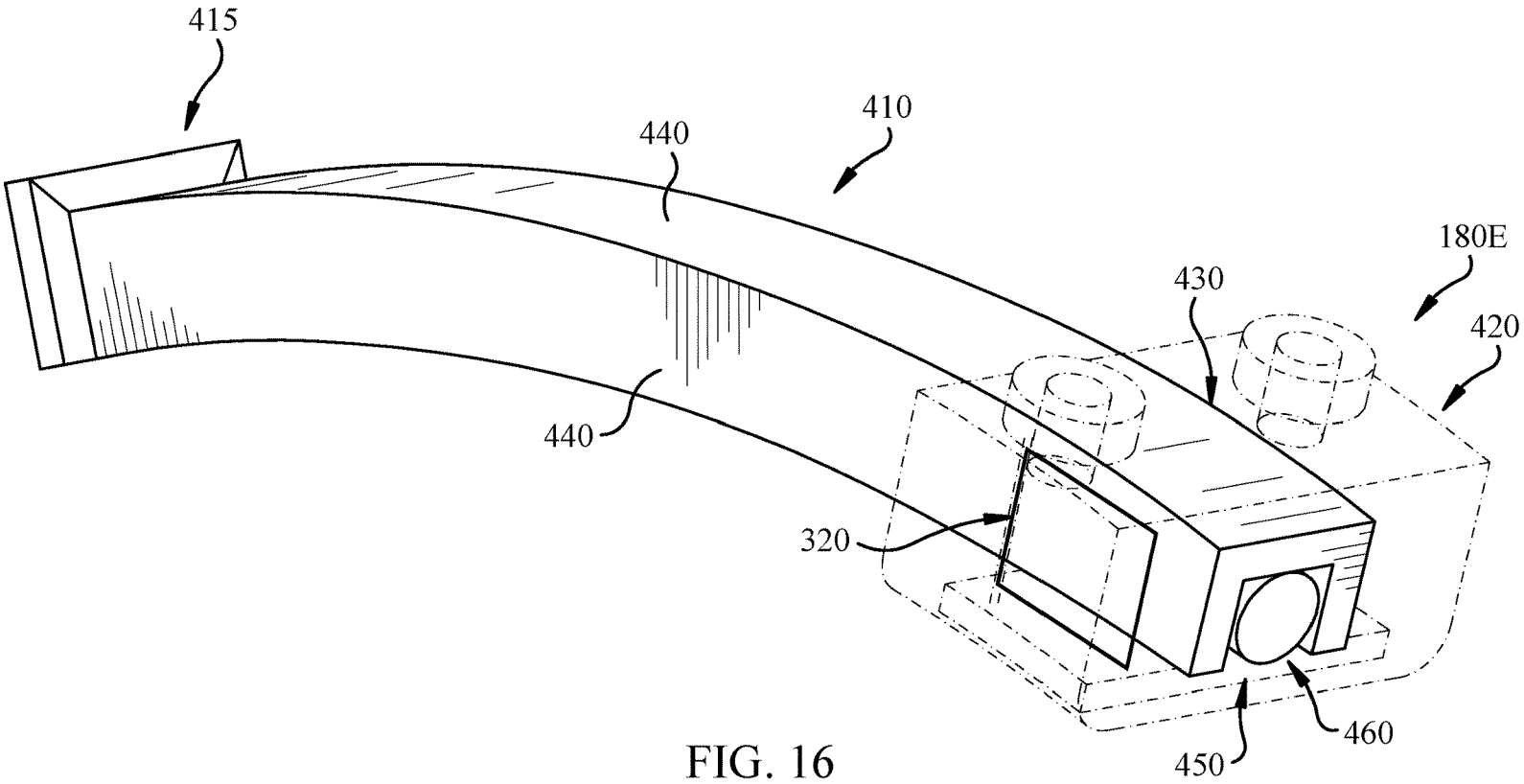
FIG. 16 shows a close-up perspective view of an embodiment of a resistance member according to various additional implementations.

FIG. 16 shows a perspective view of an additional implementation of a resistance member 180E in isolation. In these implementations, a tongue (e.g., tongue 170 or tongue 170', FIG. 7) or portion of the tongue can be formed as a substantially rigid component to facilitate controlled movement relative to the resistance member 180E. In particular cases, a tongue extension 410 is shown engaging resistance member 180E. In some implementations, the tongue extension 410 is integral with tongue(s) 170, 170' (e.g., cast, forged or otherwise formed with the tongue, FIG. 7), however, in other cases, tongue extension 410 can be separately formed and subsequently coupled with the tongue (e.g., tongue 170 or tongue 170'), e.g., at a joint 415. The tongue extension 410 can be formed of a metal such as steel or aluminum, or a thermoplastic such as polypropylene. In some implementations, the tongue extension 410 has a stiffness of approximately 2 GPa to approximately 3 GPa. In some particular cases, tongue extension 410 has a stiffness between approximately 2.4 GPa and approximately 2.8 GPa, with even more particular cases having a stiffness of approximately 2.6 GPa. In this example implementation, the stiffness of this tongue extension 410 can provide a substantially uniform resistance to movement of the earcup(s) 20 in both upward and downward (e.g., push and pull) actuation.

Resistance member 180E can include a housing 420 holding a contact pad 320 for contacting one or more surfaces of the tongue extension 410. In some cases, the housing 420 can include a slot 430 sized to accommodate the tongue extension 410. In particular implementations, the contact pad 320 is located along a side of the slot 430 to contact at least one side 440 of the tongue extension 410. As shown in this depiction, the tongue extension 410 can include a multi-sided surface, and in some cases, can include an internal tongue extension slot 450 sized to accommodate a wire 460. In some cases, the tongue extension 410 can include a U-shaped member (as seen in cross-sectional view across its primary axis). However, the tongue extension 410 can take any shape capable of interacting with resistance member 180E as described herein. The resistance member 180E can include one or more couplers 300 for engaging the headband spring 50 (e.g., FIG. 5).

Figure 17:
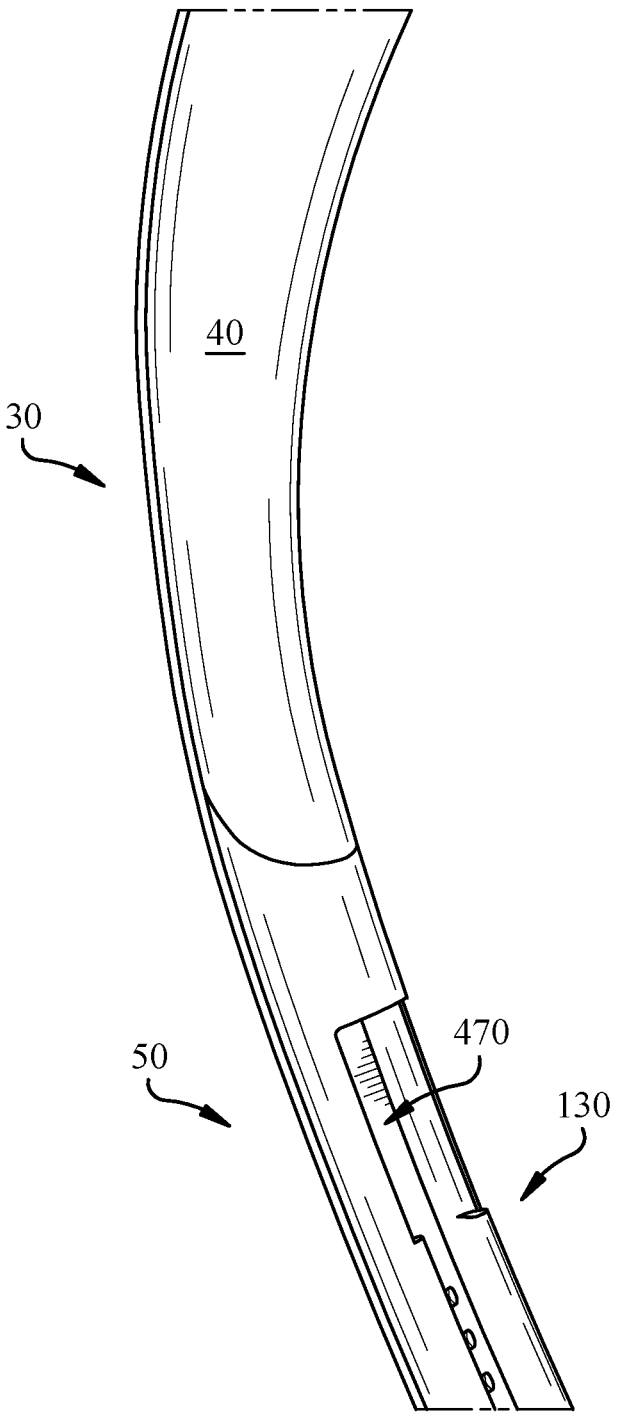
FIG. 17 shows a perspective view of a portion of a headband spring according to various implementations.

As described herein, the resistance members 180 according to various implementations can allow for controlled adjustment of the position of one or more earcups 20 in a headphone system 10 (FIG. 1). In some cases, the headphone system can further include a limiting mechanism for limiting movement of those earcups 20 (e.g., within a defined range based upon user head size and/or spacing between components contained inside head cushion 40. In some cases, as shown in FIG. 17, the internal slot 130 formed in the sleeve 110 of the headband spring 50 can include a notch 470 for receiving a limiter. One depiction of a limiter 480 is illustrated in the headphone system 10 of FIG. 4 and the headband spring 50 of FIG. 5. This limiter 480 can include an insert or removable plug sized to engage the notch 470 and restrict movement of the shoe 160 within the internal slot 130. That is, the limiter 480 can be sized to obstruct a portion of the internal slot 130 such that the range of motion of the shoe 160 is limited along the length (L) of the headband spring 50.

As described herein, the various implementations of headphone system 10 allow a user to control adjustment of one or more earcups 20 without modifying a length (L) of the headband spring 50 (FIG. 1). In other words, the continuous headband spring 50 permits adjustment of the earcup(s) 20 without modifying a seam along the outer surface 70 of that headband spring 50. In this sense, as partially illustrated in FIG. 2 and FIG. 3, the headband spring 50 is sized to engage (e.g., fit within) a spinal slot 490 in the earcup 20, such that earcup 20 is capable of sliding along the headband spring 50 (as described with reference to the adjustment apparatus 150. That is, the spinal slot 490 slidingly engages with the headband spring 50, e.g., along the range of motion of the shoe 160, in order to permit movement of the earcup 20 relative to the headband spring 50. This sliding motion can be controlled by the adjustment apparatus 150 to provide a smooth, resilient modification of the position of each earcup 20 along the length (L) of the headband spring 50.

In various implementations, components described as being "coupled" to one another can be joined along one or more interfaces. In some implementations, these interfaces can include junctions between distinct components, and in other cases, these interfaces can include a solidly and/or integrally formed interconnection. That is, in some cases, components that are "coupled" to one another can be simultaneously formed to define a single continuous member. However, in other implementations, these coupled components can be formed as separate members and be subsequently joined through known processes (e.g., soldering, fastening, ultrasonic welding, bonding). In various implementations, electronic components described as being "coupled" can be linked via conventional hard-wired and/or wireless means such that these electronic components can communicate data with one another. Additionally, sub-components within a given component can be considered to be linked via conventional pathways, which may not necessarily be illustrated.

A number of implementations have been described. Nevertheless, it will be understood that additional modifications may be made without departing from the scope of the inventive concepts described herein, and, accordingly, other implementations are within the scope of the following claims.

We claim:

1. A headphone system comprising:
- a pair of earcups;
- a continuous headband spring connecting the pair of earcups, the continuous headband spring having an internal slot with an opening along an inner surface thereof; and
- an adjustment apparatus coupled with one of the pair of earcups and the continuous headband spring, the adjustment apparatus comprising:
  - a shoe coupled with the one of the pair of earcups and positioned in the internal slot;
  - a tongue coupled with the shoe and extending at least partially along the continuous headband spring; and
  - a resistance member coupled with the tongue for resisting movement of the tongue relative to the continuous headband spring, wherein the resistance member comprises a friction box, and wherein the friction box comprises:
    - a housing coupled to the continuous headband spring; and
    - at least a set of damping pads for engaging the tongue as the tongue moves relative to the continuous headband spring.

2. The headphone system of claim 1, wherein the continuous headband spring further comprises an additional internal slot with an additional opening along the inner surface thereof, and the adjustment apparatus is further coupled with a second one of the pair of earcups, the adjustment apparatus further comprising:
- an additional shoe coupled with the second one of the pair of earcups and positioned in the additional internal slot; and
- an additional tongue coupled with the additional shoe and extending at least partially along the continuous headband spring.

3. The headphone system of claim 2, wherein the adjustment apparatus further comprises an additional resistance member coupled with the additional tongue.

4. The headphone system of claim 1, wherein the continuous headband spring permits movement of the pair of earcups without modifying a seam along an outer surface of the continuous headband spring.

5. The headphone system of claim 1, further comprising a limiter for limiting movement of the shoe within the internal slot.

6. A headphone system comprising:
- an earcup;
- a continuous headband spring connecting the earcup to an additional earcup, the continuous headband spring having an internal slot with an opening along an inner surface thereof; and
- an adjustment apparatus coupled with the earcup and the continuous headband spring, the adjustment apparatus comprising:
  - a shoe coupled with the earcup and positioned in the internal slot;
  - a tongue coupled with the shoe and extending at least partially along the continuous headband spring; and
  - a friction box coupled with the tongue for resisting movement of the tongue relative to the continuous headband spring, wherein the friction box comprises:
    - a housing coupled to the continuous headband spring; and
    - a set of damping pads for engaging the tongue as the tongue moves relative to the continuous headband spring.

7. The headphone system of claim 6, wherein the set of damping pads include silicone.

8. The headphone system of claim 6, wherein the continuous headband spring permits movement of the earcup without modifying a seam along an outer surface of the continuous headband spring.

9. A headphone system comprising:
- an earcup;
- a continuous headband spring connecting the earcup to an additional earcup, the continuous headband spring having an internal slot with an opening along an inner surface thereof; and
- an adjustment apparatus coupled with the earcup and the continuous headband spring, the adjustment apparatus comprising:
  - a shoe coupled with the earcup and positioned in the internal slot;
  - a tongue coupled with the shoe and extending at least partially along the continuous headband spring; and
  - a friction box coupled with the tongue for resisting movement of the tongue relative to the continuous headband spring, wherein the friction box comprises:
    - a housing coupled to the continuous headband spring;
    - a contact pad for engaging the tongue as the tongue moves relative to the continuous headband spring; and
    - an actuator coupled with the housing and the contact pad for maintaining contact between the contact pad and the tongue as the tongue moves relative to the continuous headband spring.

10. The headphone system of claim 9, wherein the continuous headband spring permits movement of the earcup without modifying a seam along an outer surface of the continuous headband spring.

11. The headphone system of claim 9, further comprising a limiter for limiting movement of the shoe within the internal slot.

* * * * *